United States Patent [19]

Kilsdonk

[11] 4,050,866

[45] Sept. 27, 1977

[54] APPARATUS FOR MELT-SPINNING

[75] Inventor: Harley Kilsdonk, Zevenaar, Netherlands

[73] Assignee: Akzo N.V., Arnhem, Netherlands

[21] Appl. No.: 697,481

[22] Filed: June 18, 1976

[30] Foreign Application Priority Data

June 23, 1975 Netherlands ..... 7507443

[51] Int. Cl.[2] ..... D01D 3/00

[52] U.S. Cl. ..... 425/192 S; 425/463; 425/464

[58] Field of Search ..... 425/192 S, 198, 199, 425/378 S, 382.2, 379 S, 190, 463, 464; 285/140

[56] References Cited

U.S. PATENT DOCUMENTS

| | | | |
|---|---|---|---|
| 2,118,094 | 5/1938 | McDonough et al. | 285/140 X |
| 3,500,499 | 3/1970 | Goossens | 425/192 S |

FOREIGN PATENT DOCUMENTS

| | | | |
|---|---|---|---|
| 1,458,898 | 10/1966 | France | 425/198 |
| 1,412,665 | 8/1965 | France | 425/192 S |
| 1,660,697 | 9/1971 | Germany | 425/192 S |

*Primary Examiner*—RobertD. Baldwin
*Attorney, Agent, or Firm*—Stevens, Davis, Miller & Mosher

[57] ABSTRACT

An apparatus for melt-spinning a polymer such as a polyamide or polyester has a heating jacket provided with a cavity which accommodates a spinning assembly. Preferably, the spinning assembly is exchangeable in the jacket from above and includes a housing adapted to contain a molten polymer and a spinnerette plate near one end thereof. The opposite end of the housing is closed with a lid which extends partially within the housing and partially outside the housing. That portion of the lid which extends outside the housing has a peripheral surface which slopes radially outwardly from the wall of the housing in the direction moving longitudinally from the housing. In a cylindrical vessel the sloping portion of the lid is frusto-conically shaped. The jacket is provided with a portion of gradually increasing diameter to accommodate the lid. A clamping member having diametrically opposite radially outwardly extending ears has a bore threaded in one direction and aligned with a bore in the lid threaded in the opposite direction. A threaded rod is threadably secured in the bore of the clamp and the bore of the lid to secure the two together. An annular groove is provided in the wall of the jacket and the ears on the clamping member are disposed in the groove by rotation of the assembly in the jacket to lock the assembly of clamp, lid and housing in the cavity of the jacket.

17 Claims, 8 Drawing Figures

APPARATUS FOR MELT-SPINNING

This invention relates to an apparatus for the manufacture of threads from synthetic polymers, such as polyamides or polyester by the melt-spinning method, which apparatus has a heating jacket accommodating a spinning assembly which is exchangeable preferably from above and has a housing and compartments for the supply of the melt to a spinnerette plate provided with spinning orifices.

An apparatus of this type is disclosed in Netherlands Patent Application No. 300,775. Although the performance of the disclosed apparatus is reasonable, it has some disadvantages which require improvement.

It is therefore an object of this invention to provide an improved apparatus for manufacturing threads of synthetic polymers by a melt-spinning process.

Other objects will become apparent from the following description with reference to the accompanying drawings wherein.

Figure 1:
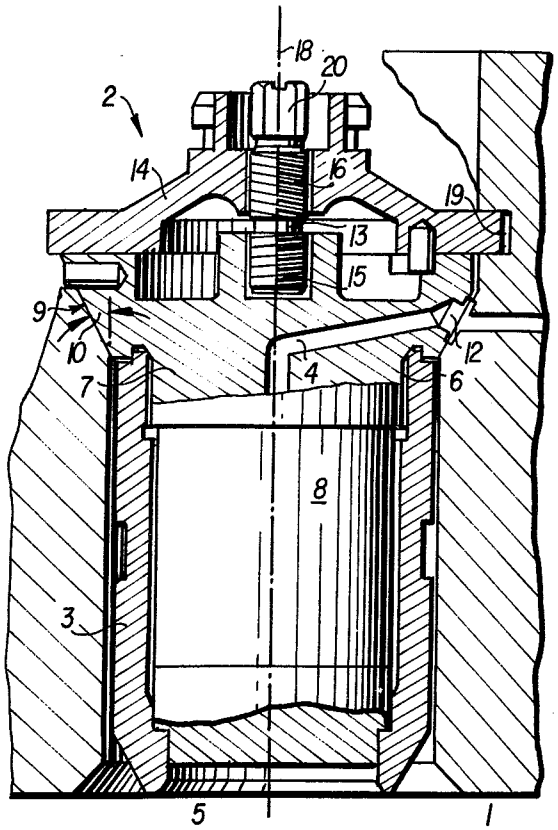
FIG. 1 is a cross-sectional view of one embodiment of an apparatus according to the invention.
Figure 2:
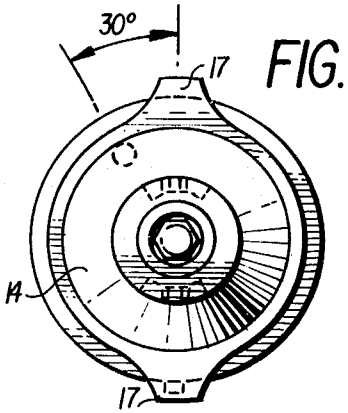
FIG. 2 is a plan view of the embodiment of FIG. 1.
Figure 3:
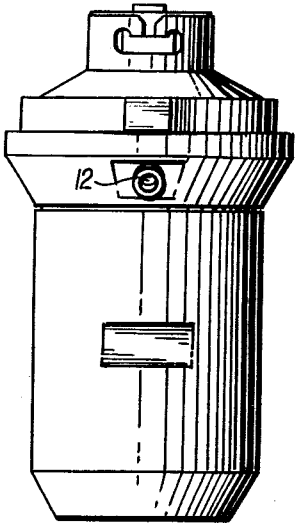
FIG. 3 is a side view of the apparatus of FIG. 1.

The apparatus for the manufacture of synthetic threads by the melt-spinning method provided by the invention has a heating jacket accommodating a spinning assembly which is exchangeable preferably from above and includes a housing and compartments for the supply of the melt to a spinnerette plate provided with spinning orifices, the upper part of the assembly being provided with a side face which projects transversely beyond the assembly housing and makes such an angle of inclination with the vertical direction of the assembly that a sloping surface is formed which bears against the identically inclined inner wall of the jacket, and communicating bores are provided in the sloping faces of the upper part of the spinning assembly and the jacket which, in their turn, connect with supply channels through the upper part of the housing and the jacket, respectively. A very effective embodiment according to the invention is characterized in that the upper part of the housing with a sloping face is in the form of a lid which can be removed in that it is provided, for instance, with a screw thread. A very effective embodiment according to the invention is characterized in that the cooperating sloping faces of the upper part and the jacket are conical.

According to the invention the assembly housing may with advantage be substantially formed by an externally cylindrical lower part and a communicating externally conical upper part whose diameter increases upwardly. Depending on the product to be made, more particularly the number of yarn forming threads or filaments to be spun simultaneously, the apparatus according to the invention may be so constructed that transverse to the vertical direction of the housing the upper part may have a long, for instance, rectangular sectional shape.

According to the invention, the above-mentioned angle of inclination is 30° to 60°, and preferably about 45°. The use of the sloping faces and the polymer supply taking place through these faces results in an optimum combination of proper centering, positioning and sealing. The fuming of the assemblies as a result of insufficient centering and sealing will no longer occur in the apparatus according to the invention in which, however, a very good heat transfer is maintained between the assembly housing and the jacket.

Because the bores containing sealing rings and communicating with the polymer channels are positioned in the sloping faces according to the invention, the placing of the assembly inside the jacket practically avoids damage to the sealing rings, becuase the sealing rings in the communicating bores of the upper part of the assembly and the jacket can be directly pressed together and there is no longer need for the components to be fitted into their positions while being in sliding contact with each other over a relatively long distance. Besides, the undamaged sealing rings will insure better sealing, which, in its turn, contributes to proper heat control and reduces the chance of the formation of fumes, which are undesirable for environmental reasons.

The apparatus according to the invention also makes it possible effectively to spin bicomponent yarns, i.e., multifilament yarns in which each filament contains two polymer components, for instance, polyester and polyamide, which are positioned in sheath-core or in side-by-side arrangement. An apparatus for the spinning of such bicomponent yarns is characterized according to the invention in that in each of the cooperating sloping faces of the upper part and the jacket there are provided two bores which, in their turn, connect with channels for the supply of the polymer materials to be spun.

The apparatus according to the invention may with advantage be characterized in that the bores in the sloping faces with the respective channels are adapted for the supply of other materials.

A melt-spinning apparatus of which the lid is provided with means for securing the assembly in the jacket is characterized according to the invention in that on the lid there is provided a clamp with projecting ears which engage in the jacket, and the clamp and the lid are intercoupled and vertically displaceable relative to each other with the aid of a threaded rod which is rotatable from above and is provided with two oppositely threaded parts, the one threaded part being screwed into the lid and the other threaded part being screwed into the clamp. The relative displacement of the lid and the clamp may, according to the invention also with advantage, be realized with the aid of a lever mechanism or by pneumatic or hydraulic means.

A further advantage of the apparatus according to the invention is that the melt-spinning assembly can very well and easily be disassembled and assembled for the periodical exchanging of components.

The melt-spinning apparatus represented in the drawing is provided with a jacket 1 heated with dowtherm and placed in the frame (not shown) of a melt-spinning machine. Inside the jacket 1 there is a spinning assembly indicated generally by 2 which is exchangeable from above and comprises a housing 3 and a channel 4 for the supply of the melt to a spinnerette plate 5 provided with a number of spinning orifices (not shown). The upper part of the housing is in the form of a detachable lid 7 which can be removed in that it is provided with a screw thread 6. Between the lid 7 and the spinnerette plate 5 is a filling block 8 in which there may be provided various channels, compartments, partitions or filters (not shown), which are of importance for the proper running of the melt-spinning process but do not form an essential part of the invention. The upper part of the assembly housing 3 in the form of the lid 7 is provided with a sloping side face 9 which projects transversely beyond the assembly housing and is placed at an angle of inclination 10 of 45° with the vertical direction of the assembly. In the embodiments represented in the drawing the sloping face 9 is formed by the conical shape of the lid 7 and a correspondingly conical shape of the jacket 1. In the cooperating conical faces of the lid 7 and the jacket 1 there are bores 12 which connect with supply channels 4 for the molten polymer material.

A clamp 14 is attached to the lid 7 by means of a threaded bolt 13. At its lower end 15 the threaded bolt 13 is left-hand threaded and its upper end 16 is right-hand threaded. The clamp 14 is provided with ears 17 which by angular displacement about the vertical axis 18 can be turned into the compartments 19 of the jacket by way of fitting grooves. In this way, the clamp 14 and the lid 7 can be vertically displaced relative to each other over a small distance by turning the hexagonal top part 20 of the clamp, so that the assembly housing can be fixed in the jacket.

Figure 4:
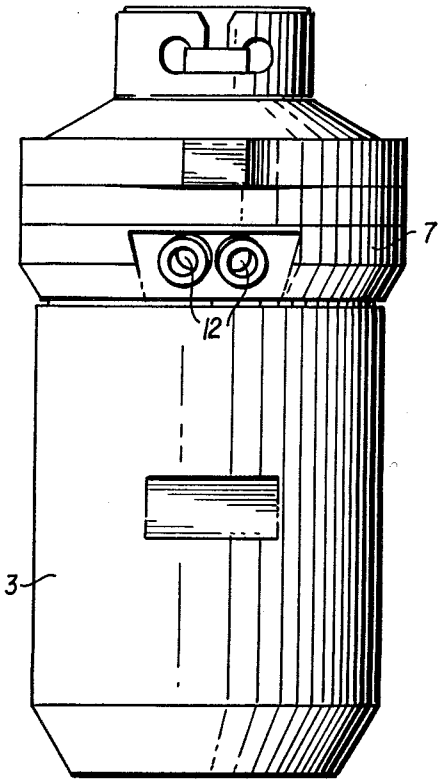
FIG. 4 is a side view of an embodiment of an apparatus for spinning bicomponent threads.

FIG. 4 shows an embodiment in which the lid 7 is provided with two bores 12. Through the one bore a molten polymer A is supplied and through the other bore a polymer B is fed to the spinnerette plate in the assembly housing 3. In such a construction, the internal part of the asembly housing should, of course, be adapted to the spining of bicomponent yarn. In principle, the oblique face may be provided with more than two bores. If required, there may also be provided one or more bores 12 which are designed to permit the supply of a liquid, a dispersion or a gas instead of the polymer materials.

Although the spinning assemblies drawn in the FIGS. 1–4 have a circular cross-section, the invention is not limited to this shape. The assembly according to the invention also may have a long, preferably rectangular, shape. The upper part of the assembly housing in the form of a lid 7 may in that case be provided with oppositely positioned wedge-shaped, oblique flat faces.

Figure 6:
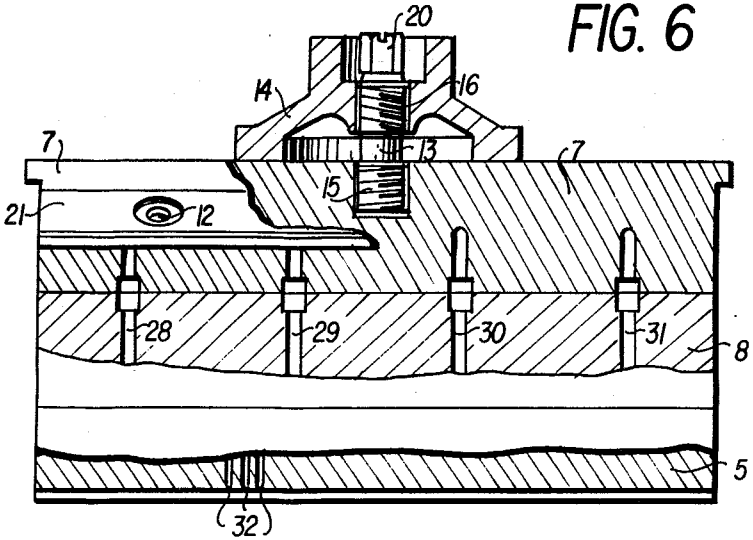
FIGS. 5 and 6 show an elongated melt-spinning assembly in cross-section and in longitudinal section.
Figure 8:
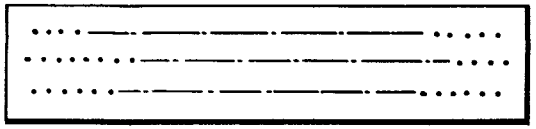
FIG. 8 is a front view of a spinnerette plate which is provided with a group of spinning holes placed in a long shaped pattern.
Figure 7:
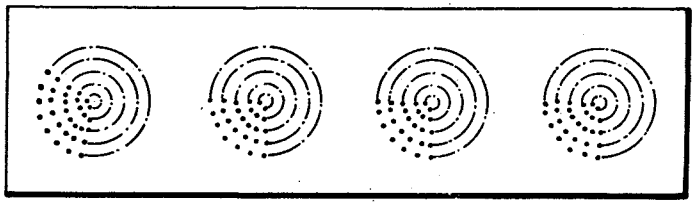
FIG. 7 is a front view of spinerette plate 5 in FIGS. 5 and 6 and shows four circular patterns of spinning holes.
Figure 5:
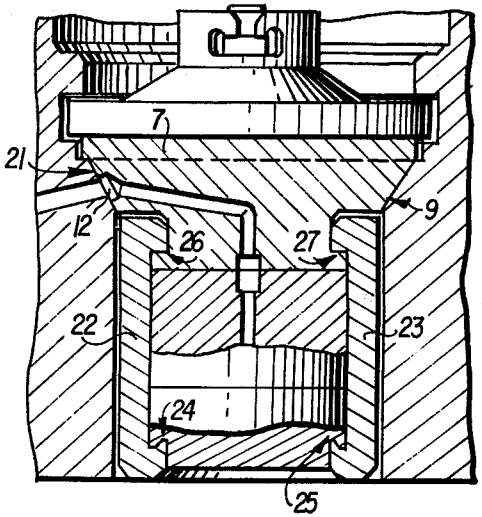

FIGS. 5 and 6 are views in cross-section and in longitudinal section of an embodiment of a spinning assembly which transverse to its vertical direction has a rectangularly shaped cross-section. In these Figures, the same reference numerals are used for the various parts as are used in the description of the embodiment of FIGS. 1–3. The lid 7, the filling block 8 and the spinnerette plate 5 also have a rectangular cross-section. The lid 2 has two sloping, flat side faces 21 which cooperate with correspondingly sloping faces of the inner wall for the jacket. The cooperating flat faces are accordingly provided with bores 12. In the assembly according to FIGS. 5 and 6, the assembly housing is substantially formed by two parallel plates 22 and 23 extending along the long sides of the assembly, which plates are provided with accommodating members 24, 25, 26 and 27 for receiving the spinnerette plate 5 and the lid 7. The filling block 8 is positioned between the spinnerette plate 5 and the lid 7. It should be added that the assembly construction with the plates 22 and 23 is known in itself from the U.S. Pat. No. 3,762,854. In the assembly according to FIGS. 5 and 6, the spinnerette plate is provided with four separate groups of spinning holes 32 placed in a certain pattern for the simultaneous spinning of four yarn bundles. To this end the assembly is equipped with four separate feed systems in the form of the channels 28, 29, 30 and 31, filters (not shown), etc.

Although the apparatus according to the invention is in the first place meant to be used for the spinning of synthetic polymers such as polyamides, polyesters, polypropylene and the like in the molten state, the apparatus may, with advantage, also be used for the spinning at an elevated temperature of liquid mixtures of polymers in solvents, which mixtures are solid at room temperature. Such mixtures may be formed, for instance, from aramides and concentrated sulphuric acid. Within the scope of the invention various modifications may be introduced.

Although the invention is described in detail for the purpose of illustration it is to be understood that such detail is solely for that purpose and that variations can be made therein by those skilled in the art without departing from the spirit and scope of the invention except as it may be limited by the claims.

I claim:

1. An apparatus for the manufacture of synthetic threads by the melt-spinning method comprising a heating jacket, a spinning assembly disposed in the jacket, said spinning assembly having a housing having two open ends and surrounding a compartment for polymer to be spun, a spinnerette plate having spinning orifices across a first of said ends, a closure member having a first portion which fits in the second of said ends and a second portion which has a sloping face which extends radially outwardly from the first portion outside the housing, said jacket having a sloping surface which bears against the sloping face of the closure member, and means for producing polymer to be spun into the compartment including a bore through the sloping surface of said jacket which communicates with a bore through the sloping face of said closure member.

2. The apparatus of claim 1 wherein the said closure member provided with a sloping face is in the form of a removably secured lid.

3. The apparatus of claim 2 wherein the lid is secured to the remaining part of the housing by means of a screw thread.

4. The apparatus of claim 1 wherein the said sloping faces of the upper part and of the jacket are conical.

5. The apparatus of claim 1 wherein the assembly housing is substantially formed by an externally cylindrical lower part and a communicating externally conical upper part whose diameter increases upwardly.

6. The apparatus of claim 1 wherein the assembly has a long cross-sectional shape in the direction transverse to its vertical direction.

7. The apparatus of claim 6 wherein transverse to the vertical direction of the assembly its upper part has a rectangular cross-sectional shape and at one or at both of the long sides of the rectangle there is provided a flat face which is inclined in the longitudinal direction of the assembly and can cooperate with a correspondingly sloping flat face on the inside of the jacket.

8. The apparatus of claim 7 wherein said cooperating sloping flat faces of the upper part and the jacket are provided with communicating bores which connect with supply channels running through the upper part.

9. The apparatus of claim 6 wherein the assembly housing is substantially formed by two parallel plates extending along the long sides of the assembly, said plates being provided with accommodating members for receiving the spinnerette plate and the lid-forming upper part of the assembly.

10. The apparatus of claim 6 wherein the spinnerette plate is provided with a group of spinning holes placed in a long-shaped pattern.

11. The apparatus of claim 6 wherein the spinnerette plate is provided with two or more separate groups of spinning holes, placed in a particular pattern, for the simultaneous spinning of two or more yarn bundles, and separate feed systems are provided in the assembly for the melt to be spun.

12. The apparatus of claim 6 in which the lid is provided with a clamp for securing the assembly inside the jacket provided with projecting ears which engage in the jacket, and the clamp and the lid are intercoupled and vertically displaceable relative to each other.

13. The apparatus of claim 12 wherein one of the bores with corresponding channels is adapted to the supply of another liquid, a dispersion or a gas instead of the polymer materials.

14. The apparatus of claim 12 wherein the clamp and the lid are vertically displaceable relative to each other with the aid of a threaded rod which is rotatable from above and provided with two oppositely threaded parts, the one part being screwed into the lid and the other part being screwed into the clamp.

15. The apparatus of claim 1 wherein said angle of inclination is 30° to 60°.

16. The apparatus of claim 1 wherein each of said sloping faces of the upper part and the jacket are provided with two or more bores which, in their turn, connect with supply channels for one or more polymer materials to be spun.

17. In an apparatus for melt-spinning a polymer having a heated jacket and a spinning assembly comprising a housing enclosed by the jacket and having a spinnerette plate at one end for the extrusion of filaments, the improvement which comprises a detachable lid closing a second end of the housing having a first portion conforming to the dimensions and shape of the said second end and disposed within the housing, a second portion integral with the first and having a sloping peripheral surface which slopes radially outwardly and longitudinally from the first portion, said jacket having a cavity therein in which said housing is disposed and having a sloping radially outwardly extending portion corresponding to the dimensions and shape of the sloping portion of the lid for the accommodation thereof, means in said jacket and lid for introducing molten polymer into the housing, said lid having a first longitudinally extending annular flange about the periphery thereof projecting longitudinally above the portion having the sloping peripheral surface, and a second concentric annular flange encircling the longitudinal axis of the lid, the internal surface of the second flange having a left-hand thread, a clamping member disposed on the lid having an axial bore aligned with the bore of the second flange and having a right-hand thread on its inner surface, a bolt having a right-hand thread at one end and a left-hand thread at its opposite end threadably secured in the bores of the second flange and the clamp securing the lid clamp to the lid, a pair of diametrically opposite ears on the clamping member extending outwardly therefrom, and complimentary grooves in the jacket whereby said clamping member can be rotated to dispose the ears in the groves and lock the clamp and spinning assembly in the jacket.

* * * * *